United States Patent [19]

Meyers

[11] 4,256,256

[45] Mar. 17, 1981

[54] MULTIPLE COMPARTMENT POUCH AND METHOD OF MAKING SAME

[75] Inventor: George L. Meyers, Ashland, Ohio

[73] Assignee: American Can Company, Greenwich, Conn.

[21] Appl. No.: 34,724

[22] Filed: Apr. 30, 1979

[51] Int. Cl.[3] ..... B65D 30/22

[52] U.S. Cl. ..... 229/56; 426/120

[58] Field of Search ..... 229/56; 206/219, 220, 206/221, 222; 426/79, 119, 120, 124

[56] References Cited

U.S. PATENT DOCUMENTS

| | | | |
|---|---|---|---|
| 2,643,049 | 6/1953 | Bartelt | 150/3 |
| 2,687,130 | 8/1954 | Cohen | 206/222 |
| 2,899,318 | 8/1959 | Long | 426/120 X |
| 3,250,384 | 5/1966 | Perino | 206/219 |
| 3,255,872 | 6/1966 | Long et al. | 206/219 |
| 3,293,048 | 12/1966 | Kitterman | 426/124 X |
| 3,573,069 | 3/1971 | Keller et al. | 206/219 X |
| 3,674,134 | 7/1972 | Turner | 206/219 |
| 3,950,158 | 4/1976 | Gossett | 206/219 X |

FOREIGN PATENT DOCUMENTS

| | | | |
|---|---|---|---|
| 133376 | 1/1933 | Fed. Rep. of Germany | 229/56 |
| 2500100 | 7/1976 | Fed. Rep. of Germany | 426/79 |

*Primary Examiner*—Stephen P. Garbe

*Attorney, Agent, or Firm*—Robert P. Auber; Ira S. Dorman; Harry C. Engstrom

[57] ABSTRACT

A pouch for use in packaging food or similar granular materials is disclosed which includes at least two different and segregated pouch compartments combined in a single unit. The two pouches may be each formed of different sheet materials so that a differential level of protection may be provided for the different materials in each of the two pouches. The two pouches are simultaneously formed in a folding and sealing machine with the top edges of the two pouches being sealed together to form a single dual compartment package.

1 Claim, 7 Drawing Figures

MULTIPLE COMPARTMENT POUCH AND METHOD OF MAKING SAME

BACKGROUND OF THE INVENTION

1. Field of the Invention

The present invention relates to food packages in general, and, in particular, to pouch-type flexible receptacles having two or more compartments formed therein for two or more types of food material.

2. Description of the Prior Art

The prior art is generally cognizant of the use of folded flexible sheet material type pouches for use in packaging foods or similar granular or particulate materials. The prior art is also generally cognizant of the use of two of such pouches joined together to form a unitary package. It has been the general practice in the art heretofore, however, that such dual package types of pouches are formed by a single sheet of material which is doubly folded to form two separate and distinct pouches from the same material. In such an arrangement, both of the pouches must be formed of identical character sheet material since they are each formed from the same sheet of material so that the material of both pouches must be protective enough to protect the more delicate of the two materials received in the pouches. It is also common place in the art to form two separate and distinct pouch-type containers for different materials which are then packaged together in a larger and more rigid box or other container with the disadvantage that the larger box is then required to keep the two pouch-type containers together in a single package.

SUMMARY OF THE INVENTION

The present invention is summarized in that a pouch for use in packaging food or similar materials includes a first pouch formed of a single folded-over sheet of flexible sheet material with the fold defining the bottom of the pouch, the sheet material of the first pouch having a first pre-selected level of protective ability, the first pouch being sealed at its top and side edges, and a second pouch formed of a single folded-over sheet of flexible sheet material with the fold defining the bottom of the pouch, the sheet material of the second pouch having a second pre-selected level of protective ability, the second pouch also being sealed at its top and side edges, the sealed top edges of the first and second pouches being positioned together and sealed to each other to form a single dual compartment pouch.

It is an object of the present invention to provide a dual compartment pouch for food or other similar of granular materials in which the size of the two compartments, which are formed as two separate pouches, may be varied as desired for the particular application.

It an another object of the present invention to provide such a dual ccompartment pouch for food or similar materials in which the two pouches may be formed of sheet materials having differing levels of protective ability to provide varied custom-designed protection for the contents of each of the two pounds.

It is another object of the present invention to provide a method for constructing dual compartment pouches in accordance with the present invention in a rapid and efficient manner so that the dual compartment pouches may be manufactured in an economical and efficient manner.

Other objects, advantages, and features of the present invention will become apparent from the following specification when taken in conjunction with the accompanying drawings.

DESCRIPTION OF THE PREFERRED EMBODIMENT

Figure 1:
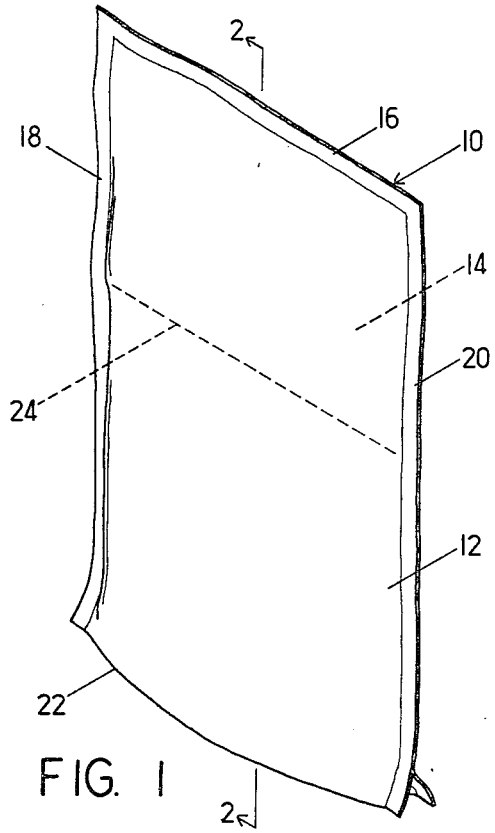
FIG. 1 is a perspective view of a dual compartment pouch constructed in accordance with the present invention.
Figure 2:
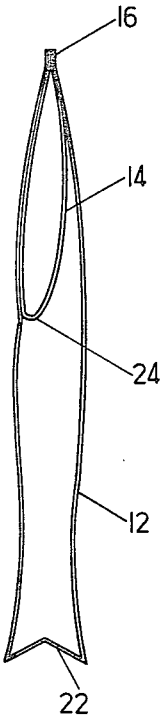
FIG. 2 is a cross-sectional view taken along the lines 2—2 in FIG. 1.

Shown in FIGS. 1 and 2 is a dual compartment food pouch, generally indicated at 10, constructed in accordance with the present invention. The food pouch 10 includes a major pouch 12 formed in a relatively large size and a minor pouch 14 which is of a smaller size and is received entirely within the major pouch 12. The major pouch 12 and the minor pouch 14 are both closed at their common top edges by a common top edge seal 16, while a pair of common side edge seals 18 and 20 seal the opposite side edges of the two pouches. Each of the pouches 12 and 14 is formed of a single sheet of flexible sheet material which is folded upward upon itself to form the pouch. The major pouch 12 is formed of a large sheet of such sheet material folded upward on itself along the bottom edge margin 22 of the major pouch 12. As can be seen in FIG. 2, at the bottom margin 22 a slight infolded portion is provided to enlarge the bottom of the pouch 12 so that it will have a larger internal capacity. Similarly, the minor pouch 14 is folded from a single sheet of flexible sheet material which is folded upward upon itself along the bottom edge 24 of the minor pouch 14. Thus, no seal need be provided at the bottom of either of the pouches 12 and 14 inasmuch as the sheet material itself provides a continuous and closing surface.

Figure 3:
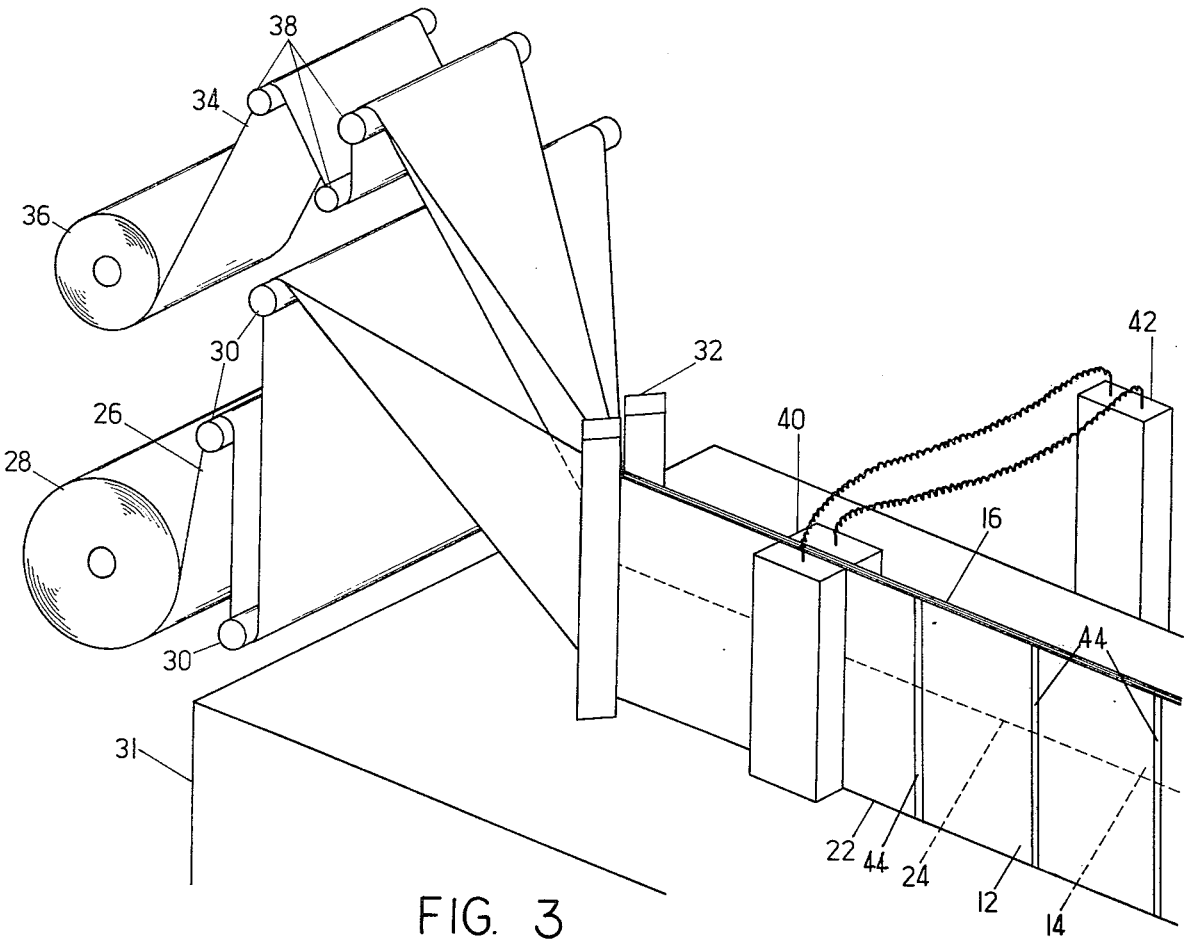
FIG. 3 is a perspective schematic view of a portion of the apparatus used to construct the pouch of FIG. 1.

Shown in FIG. 3 is a portion of an apparatus suitable for constructing the dual compartment food pouch 10 of FIGS. 1 and 2. An elongated indeterminate length sheet of material 26, suitable for use in the major pouch 12, is rolled off of a large roll 28 which serves as the supply of the sheet of material 26. From the roll 28, the sheet of material 26 advances over a series of guide rollers 30 from whence it proceeds to a folding station 32. The folding station 32 consists of a pair of upright posts spaced closely together on a work table 31. The last of the guide rollers 30 is raised above the folding station 32 and is linearly aligned therewith so that the sheet of material 26 is folded along its longitudinal center line over onto itself so that its two lateral edges are brought together at the top edge of the vertically positioned sheet as it enters the folding station 32. Meanwhile, another sheet of material 34, suitable for use as the material of the minor pouch 14, is rolled off of a supply roll 36. The sheet of material 34 as it is rolled off of the roll 36 passes over a series of guide rollers 38 to also go to the folding station 32. Similar to the last of the rollers 30, the last of the rollers 38 is positioned above and linearly aligned with the folding station 32 so that the sheet of material 34 is folded along its longitudinal center line over onto itself so that its lateral edges are brought together as it travels into the folding station 32. As can also be seen in FIG. 3, the guide rollers 30 and 38 are mutually aligned with the guide rollers 38 higher so that the sheet of material 34 proceeds inside of the sheet of material 26 as they both proceed toward the folding station 32 so that as the two sheets are folded along their respective longitudinal center lines by the folding station 32, the folded inner sheet 34 is received inside the folded outer sheet 26 with the top edges of the two folded sheets being adjacent each other. The sheets together proceed in this folded fashion to a heat sealing station 40 which is provided with a suitable source of power by a power source 42. The heat sealing station 40 periodically forms a series of vertical seals 44 in the two sheets of material to form a series of attached major pouches 12 and inner minor pouches 14. At some later step in the process the pouches 12 and 14 are filled with product and then sealed along their top edges 16, after which the pouches 12 and 14 are then cut from each other by slicing each of the vertical seals 44 in half to form each of the side seals 18 and 20, and to thus complete the food pouch 10.

The food pouch 10 of FIGS. 1 and 2 as constructed in accordance with the present invention offers several significant advantages over the prior art. One of the most significant advantages is best understood with reference to the method of manufacturing the pouch 10, as is illustrated in FIG. 3. Inasmuch as the two sheets of material 26 and 34 which ultimately form the pouches 12 and 14 emanate from two entirely different rolls of material, i.e., the rolls 28 and 26, it is entirely possible and desirable to select two entirely different types of sheet material for the sheets 26 and 34 and thus two entirely different types of sheet materials for the two pouches 12 and 14. This allows each of the two compartments of the food pouch 10 to be custom designed for the degree of protectiveness required for the particular product intended to be carried inside of that respective pouch 12 or 14. Thus, for example, it is often the custom in convenience food type of applications to include a larger volume of product, which requires less severe protection from moisture and air contamination, and a smaller quantity of flavor mix and/or gravy, which must be strictly protected from moisture and air contamination. Thus, in such an application, it would be desirable for the inner pouch 14 to be fabricated from a sheet of material 34 which includes a layer of metallic foil therein, such as a laminate material of metallic foil, paper, and sheet thermoplastic material such as polyethylene, polyvinyl chloride or similar polymerized material. Meanwhile, the sheet of material 26 for use as a material of the major pouch 12 may be constructed of a less strictly protective material, such as a simple laminate of paper and thermoplastic material. This allows a significant cost savings for the overall food pouch 10 inasmuch as the tighter level of protection is only required for this specific small volume of material requiring that protection. Thus in the food pouch 10 each of the pouches 12 and 14 can have a pre-selected level of protective ability, with the level of protective ability of each of the pouches 12 and 14 varying as desired for the particular application.

In general in the food pouch 10 it will be preferable for the material of the major pouch 12 to be laminate of paper and thermoplastic material with the thermoplastic layer being arranged on the inside of the major pouch 12. The thermoplastic layer is arranged on the inside to help form a firm seal at the top edge seal 16 to the minor pouch 14. Similarly the material the minor pouch preferably consists of layers of paper, thermoplastic, metal foil and a second layer of thermoplastic, with the second thermoplastic layer being disposed on the inside to aid in sealing the top edge seal 16.

Another advantage of the food pouch 10 of the present invention is that the two pouches 12 and 14 are integrally joined together so that one may not become detached from the other. This feature helps to insure that one or the other of the pouches, typically the smaller of the two, will not be lost during transit and handling as may sometimes occur. An examination of FIG. 3 also reveals another advantage of the present invention in that it is relatively easy to implement in conventional machinery. Thus in conventional pouch-forming apparatus, a continuous sheet of material is normally fed through a folding station similar to the folding station 32. In the apparatus of FIG. 3, that arrangement has been maintained, with only the addition of an additional roller and sheet material to that combination. Thus an overall efficiency in manufacture is achieved inasmuch as rather than the need to manufacture two separate and individual pouches, two pouches which are integrally connected are simultaneously manufactured in one of the operations previously required in order to construct just one of the two pouches.

Figure 4:
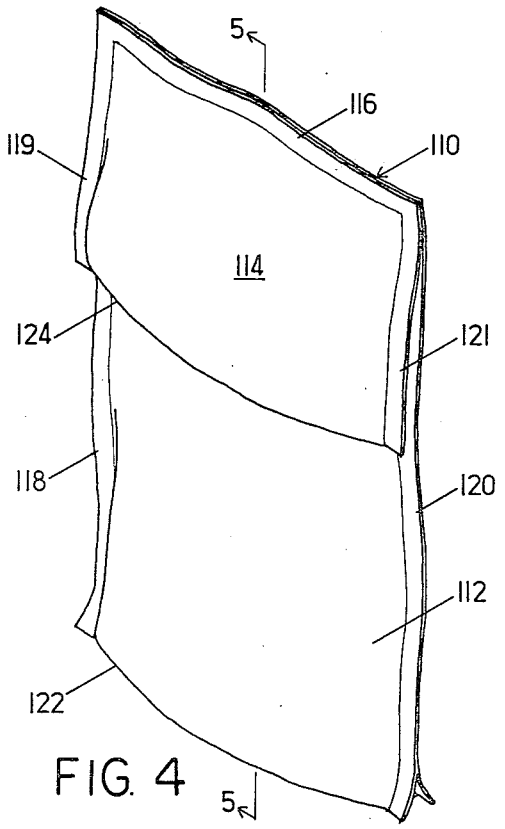
FIG. 4 is a perspective view of an alternative embodiment of a dual compartment pouch constructed in accordance with the present invention.
Figure 5:
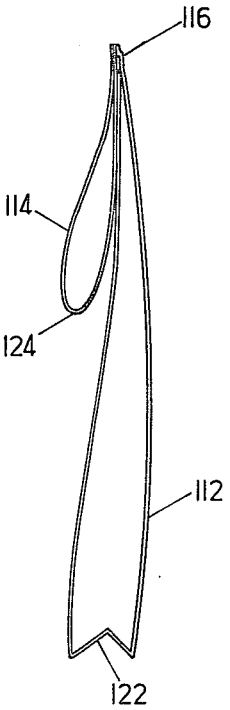
FIG. 5 is a cross-sectional view taken along the line 5—5 in FIG. 4.

Shown in FIG. 4 is a food pouch, generally indicated at 110, constructed in accordance with an alternative embodiment of the present invention. The food pouch 110 includes a major pouch 112 and a minor pouch 114 which are joined together at their upper sealed top edges 116. The side edges 118 and 120 of the major pouch 112 are sealed as are the side edges 119 and 121 of the minor pouch 114. Each of the pouches 112 and 114 is formed of a single sheet of flexible sheet material folded back about itself and a bottom margin edge 122 and 124 respectively serve as the fold lines for the folding of each of the two sheets of materials in the major pouch 112 and the minor pouch 114. As can be seen in FIG. 5, the material of the major pouch 112 is folded slightly off of its centerline so that the top of the front face of the pouch terminates slightly below the top of the rear face for reasons that will be discussed below.

Figure 6:
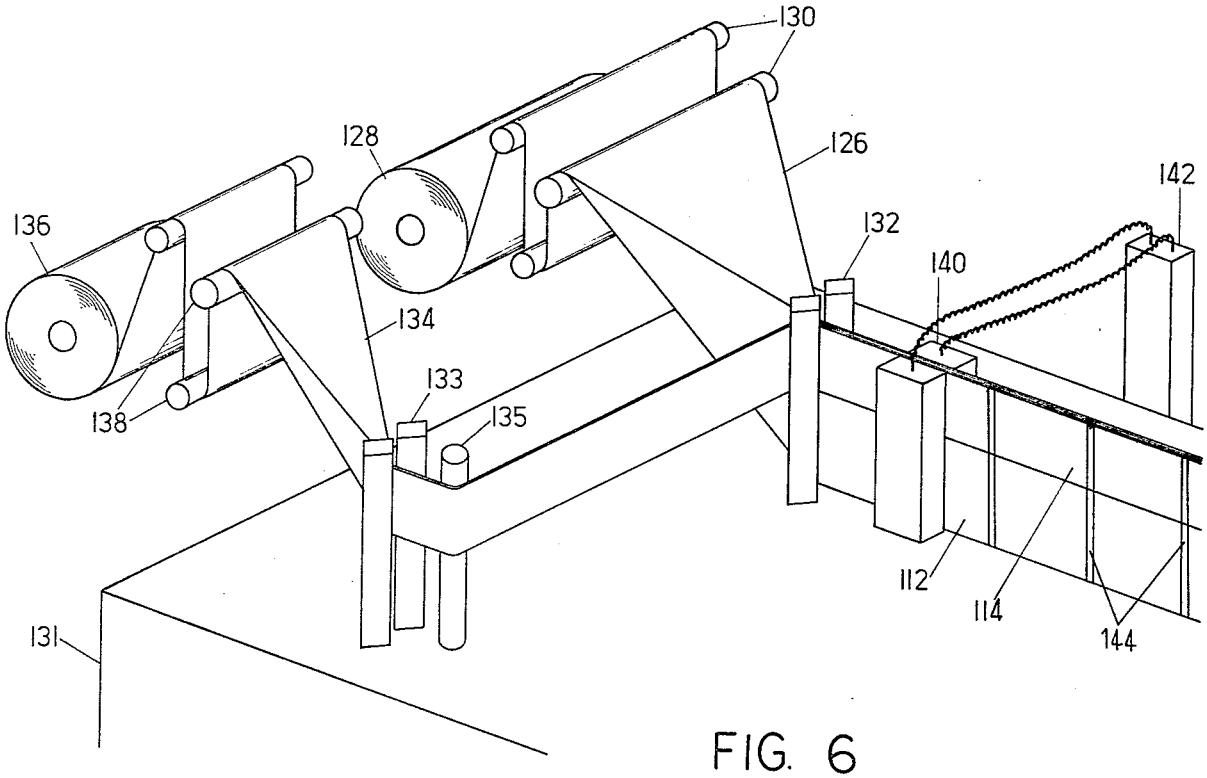
FIG. 6 is a perspective schematic view of a portion of an apparatus used to construct the pouch of FIG. 4.

Shown in FIG. 6 is a method for manufacturing the food pouch 110 of FIGS. 4 and 5. As can be seen in that figure, a sheet of material 126, similar to the material 26 used in the embodiment of FIGS. 1–3, is rolled off of the supply roller 128 over a series of guide rollers 130 to a folding station 132. At the folding station 132 the sheet of material 126 is folded along a longitudinal line near the center line of the sheet back upon itself so that its lateral edges are brought together at the top of the folding station 132. Meanwhile, a second sheet of material 134, similar to the sheet of material 30 of FIG. 3, is rolled off of a second supply roller 136 over a series of guide rollers 138 to a second folding station 133 also located on the work table 131. The sheet of material 134 is folded along its longitudinal center line by the folding station 133 so that its lateral edges are brought together at the top of the folded sheet thus produced. The folded sheet 134 is brought from the folding station 133 about a guide 135 to be guided to the folding station 132 at which point it is pressed into juxtaposed relation with the side of the folded sheet of material 126. The two sheets of material 126 and 134 are then brought in their juxtaposed folded condition to a sealing station 140 which is connected to a suitable source of power 142. The sealing station 140 forms vertical seals 44 in the two sheets of material to form a series of major pouches 112 and minor pouches 114 from the two sheets. The major pouches 112 are attached to the minor pouches 114 by the very uppermost portion of the vertical seals 114, i.e., that portion that will form the corners of the top edge seals 116. At these corner portions the shortening of the front face of the major pouch 112 serves to bring the upper back surface of the minor pouch 114 in contact with the inner surface of the rear face of the major pouch 112 so that the minor pouch 114 is sealed to the major pouch 112 by the thermoplastic layer on the interior of the major pouch 112. The pouches 110 may then be filled with product and sealed at their top edges 116. Then the vertical seals 144 may be cut to form the side edge seals 118 and 120 and 119 and 121 to complete the pouch 110.

The food pouch 110, as illustrated in FIGS. 4 and 5, and the method of constructing the same as shown in FIG. 6, offer advantages similar to that of the food pouch 10 of FIGS. 1–3. The food pouch 110 may be preferred over the food pouch 10 for particular applications in which it is not desired to simultaneously open the major pouch and the minor pouch at the same time, as would be the usual practice with the food pouch 10. With the food pouch 110, it is possible by appropriate manipulation and location of the tears made in each of the major pouch 112 and the minor pouch 114 to selectively open one and then the other of the two pouches. With the addition of this one extra feature, the food pouch 110 offers all the advantages obtainable with the food pouch 10. Similarly the process of making the food pouch 110 also requires only a minor addition to the apparatus required to make a similar food pouch having only a single compartment, as may readily be seen by viewing FIG. 6.

Figure 7:
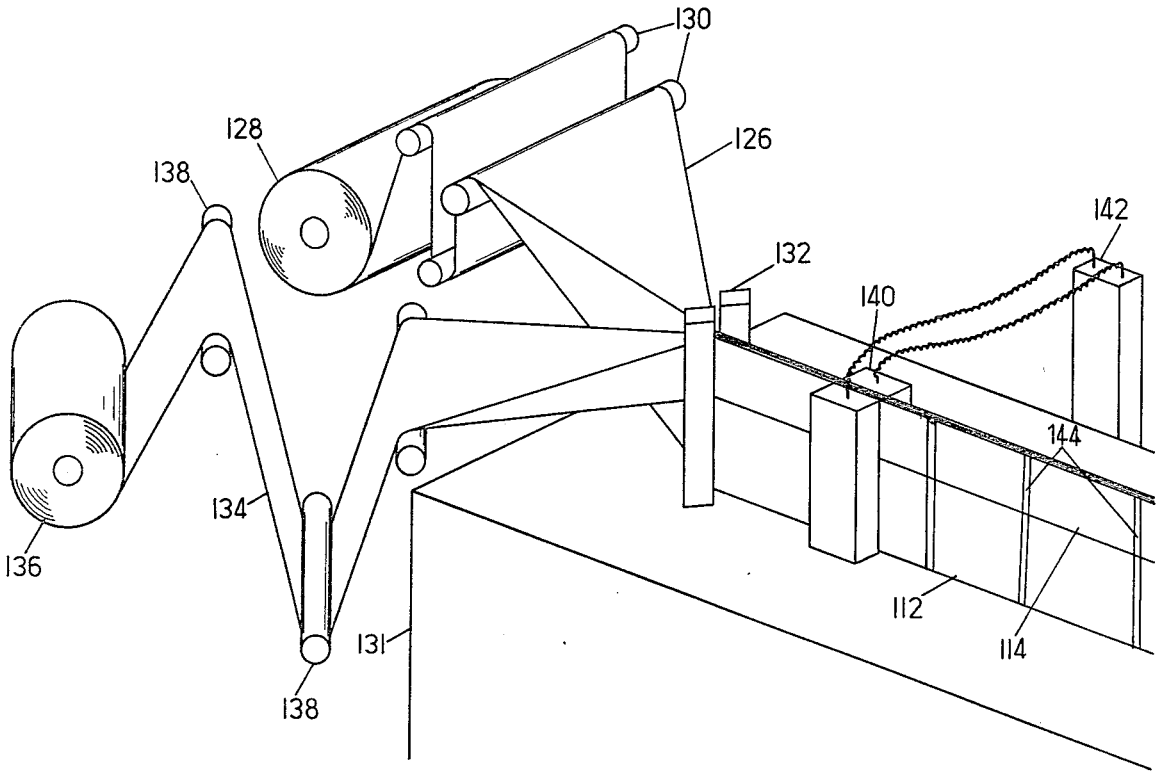
FIG. 7 is an alternative embodiment of the apparatus of FIG. 6.

Shown in FIG. 7 is an alternative embodiment for the manufacture of the food pouch 110 as FIGS. 4 and 5. In this embodiment the second folding station 133 and the guide 135 has been omitted by guiding the sheet of material 134 at an oblique angle directly into the folding station 132. The apparatus as shown in FIG. 7 is generally equivalent to that shown in FIG. 6, and the particular choice between these two methods as may be desired for the particular application will more probably be dictated by the convenient location obtainable for the second supply roll 136 and the travel area required by the second sheet 134 than by any other consideration.

It is understood that the present invention is not limited to the particular construction and arrangement of parts disclosed and illustrated herein, but embraces all such modified forms thereof as come within the scope of the following claims.

I claim:

1. A pouch for use in packaging food or similar material comprising:

(a) a first pouch formed of a single folded-over sheet of flexible sheet material with the fold defining the bottom of the pouch, said first pouch having inner and outer surfaces and front and rear faces, the sheet material of the first pouch having a first pre-selected level of protective ability and being a laminate of paper and thermoplastic material with the thermoplastic material positioned on the inside of the pouch, the first pouch being sealed at its top and side edges;

(b) a second pouch positioned adjacent to the first pouch and formed of a single folded-over sheet of flexible sheet material with the fold defining the bottom of the pouch, the sheet material of the second pouch having a second pre-selected level of protective ability and being a laminate of paper, metal and thermoplastic material, the second pouch also being sealed at its tcp and side edges; and (c) the sealed top edges of the first and second pouches being positioned together and sealed to each other to form a single dual compartment pouch, the sheet of material of the first pouch being folded over slightly off of its centerline so that one of the faces of the first pouch is longer than the other so that the inner surface of the longer face of the first pouch is brought into contact with the second pouch and sealed thereto to attach the second pouch to the first pouch.

* * * * *